US009434081B2

(12) United States Patent
Kumar

(10) Patent No.: US 9,434,081 B2
(45) Date of Patent: Sep. 6, 2016

(54) SHAVING DEVICE WITH RAZOR AND APPLICATOR HEADS

(71) Applicant: Selva Kumar, Houston, TX (US)

(72) Inventor: Selva Kumar, Houston, TX (US)

(73) Assignee: Selva Kumar, Houston, TX (US)

( * ) Notice: Subject to any disclaimer, the term of this patent is extended or adjusted under 35 U.S.C. 154(b) by 0 days.

(21) Appl. No.: 13/932,904

(22) Filed: Jul. 1, 2013

(65) Prior Publication Data

US 2014/0033537 A1 Feb. 6, 2014

Related U.S. Application Data

(60) Provisional application No. 61/690,620, filed on Jul. 2, 2012, provisional application No. 61/796,016, filed on Nov. 1, 2012, provisional application No. 61/850,046, filed on Feb. 6, 2013.

(51) Int. Cl.
*B26B 21/40* (2006.01)
*B26B 21/44* (2006.01)
*A45D 27/00* (2006.01)

(52) U.S. Cl.
CPC ..... *B26B 21/446* (2013.01); *A45D 27/00* (2013.01); *B26B 21/4081* (2013.01); *B26B 21/44* (2013.01); *Y10T 29/49817* (2015.01)

(58) Field of Classification Search
USPC ..... 30/34.05, 41.5, 47–51, 538, 34.1, 41, 30/535, 537, 541
See application file for complete search history.

(56) References Cited

U.S. PATENT DOCUMENTS

| | | | | |
|---|---|---|---|---|
| 4,182,031 | A * | 1/1980 | Cecil, Jr. | 30/47 |
| 4,831,729 | A * | 5/1989 | Beuchat | 30/40.2 |
| 4,944,090 | A * | 7/1990 | Sumnall | B26B 21/443 30/41 |
| 5,384,961 | A * | 1/1995 | Gregory | B26B 21/44 30/41 |
| 5,765,407 | A * | 6/1998 | Choo | A47L 25/08 15/104.94 |
| 5,842,488 | A * | 12/1998 | Belleau | A45D 34/04 132/320 |
| 6,560,876 | B2 * | 5/2003 | Carr | 30/50 |
| 8,166,658 | B2 * | 5/2012 | Nakasuka | 30/41 |
| 9,119,946 | B2 * | 9/2015 | Dokken | A61M 35/006 |
| 2004/0194325 | A1 * | 10/2004 | Ehrlich et al. | 30/526 |
| 2009/0178282 | A1 * | 7/2009 | Guay et al. | 30/41.5 |

* cited by examiner

*Primary Examiner* — Sarah McPartlin

(57) ABSTRACT

A skin care and shaving system is provided comprising disposable razor cartridge with one or more blades, skin engaging applicator member made of sponge like material and a handle for holding. The sponge like material includes small and large pore sponge and also foam pad which helps in applying all kinds of skin shaving enhancer such as shaving cream, lotion, gel, moisturizer during pre and post shave. Further, in another aspect of the present invention, it is provided a skin enhancer cartridge comprising a handle and a skin engaging applicator member without and razor blades attached to the system. The product of the present invention is a disposable one wherein the whole shaving system is disposable or in some cases the handle of the cartridge can be reused.

14 Claims, 9 Drawing Sheets option 2

FLOW CHART

SHAVING DEVICE WITH RAZOR AND APPLICATOR HEADS

FIELD OF INVENTION

The present invention relates to a skin care and shaving system and, more specifically, to improved shaving system with a skin enhancer cartridge used in both pre and/or post shaving.

BACKGROUND

The present invention relates to a skin care and wet shaving system. In the present state of art, as part of a wet shaving system, a user typically applies a skin preparation, e.g., shaving soap, shaving foam, shaving gel, skin conditioning foam, etc., to their skin using a brush or their hands prior to actually shaving their hair. This can, however, be a messy and lengthy process and requires the use of multiple products/tools to enable a person to prepare their skin for shaving.

As further known in the art, a wet shave razor cartridge is usually composed of a cartridge housing, blades having cutting edges, a guard area in front of the blades and a cap area having a shaving aid or lubricating strip (e.g., most commonly referred to as a Lubrastrip™) disposed behind the blades. Each component plays a unique role during shaving.

The present invention provides a new and simple approach to shaving system that comprises skin care facilities by using soft sponge like material coupled to the shaving cartridge for easy application of shaving lotion, creams, moisturizer and other shaving enhancers thereof. The present invention eliminates the use of brushes, lubricating strip or the like during shaving process.

BRIEF SUMMARY OF THE INVENTION

According to an aspect of the present invention, there is provided a skin care and wet shaving system comprising cartridge with one or more razor blades, a skin engaging applicator member present on the handle of the cartridge used for application of all types of skin enhancers such as shaving foam, shaving gel, skin conditioning foam, shaving cream/lotion, skin cream, moisturizer used during pre and/or post shave.

According to another aspect of the present invention, there is provided a skin enhancer cartridge comprising a skin engaging applicator member present on the head of the cartridge and a handle for holding the cartridge. The kind of cartridge does not comprise any razor blades and is used pre and/or post shaving for application of skin enhancers such as shaving foam, shaving gel, skin conditioning foam, shaving cream/lotion, skin cream, and moisturizer thereof. Shaving is carried out with normal available razor blade cartridges.

In an embodiment of the present invention, the skin engaging applicator member comprises sponge material such as latex free sponge, small and/or large pore sponge, hydrophilic foam pad or the like which helps in easy application of lotions and cream on the skin in pre or post shave.

In an embodiment of the present invention, shaving system may contain disposable razor cartridge and disposable applicator member coupled to reusable handle. Yet in another embodiment, the whole shaving cartridge product including razor blades, applicator member and handle can be combined into a unitary disposable product. The handle of the cartridge can be made of stiff pliable plastic material or hard rubber material with rough surface that enables firm holding of the cartridge.

In an embodiment, a razor cartridge is secured detachably to the tip of the handle of the shaving system through grip arrangement fixation technique. In another embodiment, a razor cartridge is secured to the handle through a linkage pivotally connected to the handle. The linkage is connected to the razor cartridge and the handle in a manner that the razor cartridge moves flexibly relative to the handle during shaving. In this type of shaving system, the skin engaging applicator member is detachably fixed on the body of the cartridge handle through grip arrangement method, while in another type of skin enhancer cartridge, the applicator member with the sponge material is secured detachably to the tip of the handle through grip arrangement fixation technique or secured through a linkage pivotally connected to the handle for flexi-movement.

Further, it is an aspect of the present invention wherein the skin enhancer cartridge product is advantageous to the user in a manner that it reduces razor bumps, reduces razor irritation, smooth skin, promotes a close and easy shave and is a fragrance and color free product.

BRIEF DESCRIPTIONS OF THE DRAWINGS

Embodiments of the present invention will hereinafter be described, by way of example, with reference to the accompanying drawings, in which:

FIG. 1 shows a schematic illustration of an exemplary embodiment skin care and shaving system including a handle, a razor cartridge, and an applicator member removably retained in the handle, in accordance with the present invention;

FIG. 1*a* shows a schematic illustration of an alternate embodiment of a handle designed such that the handle tip can be detachably attached to conventional razor blades;

FIG. 1*b* shows a schematic illustration of an alternate embodiment of a handle having blunt shapes on both ends;

Figure 11A:
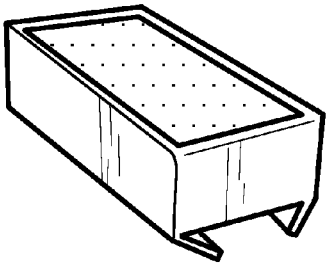

FIG. 11*a* shows a schematic illustration of an applicator comprising a sponge material attached to a base.

Figure 11B:
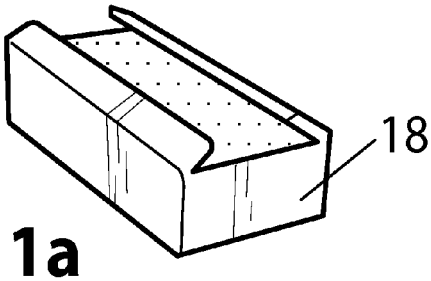
Figure 11C:
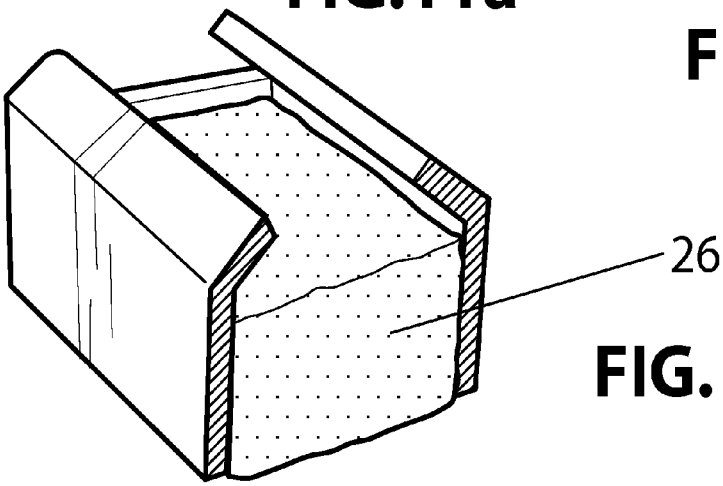

FIG. 11*b* shows a schematic illustration of the applicator of FIG. 11*a* showing an attachment side;

FIG. 11*c* shows a cross-sectional schematic illustration of the applicator of FIG. 11*b;*

Figure 11D:
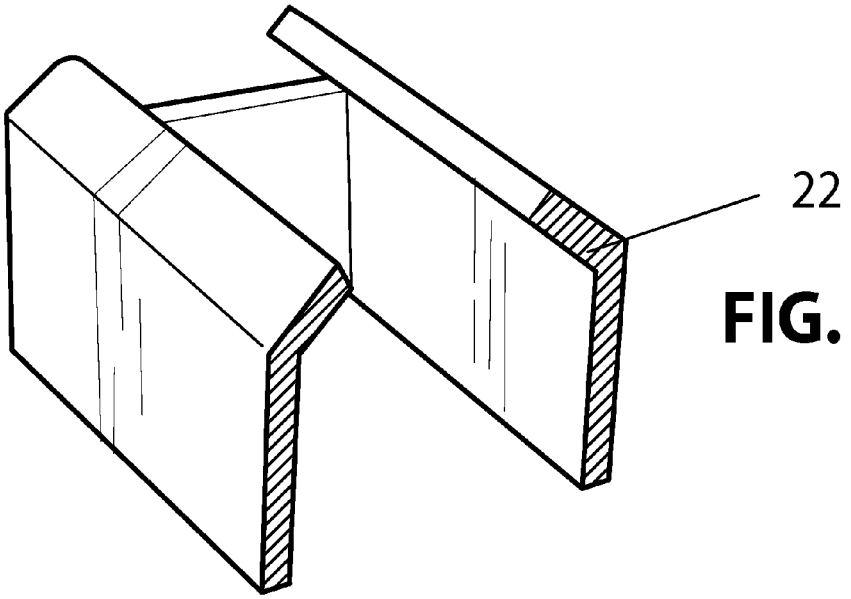
Figure 12:
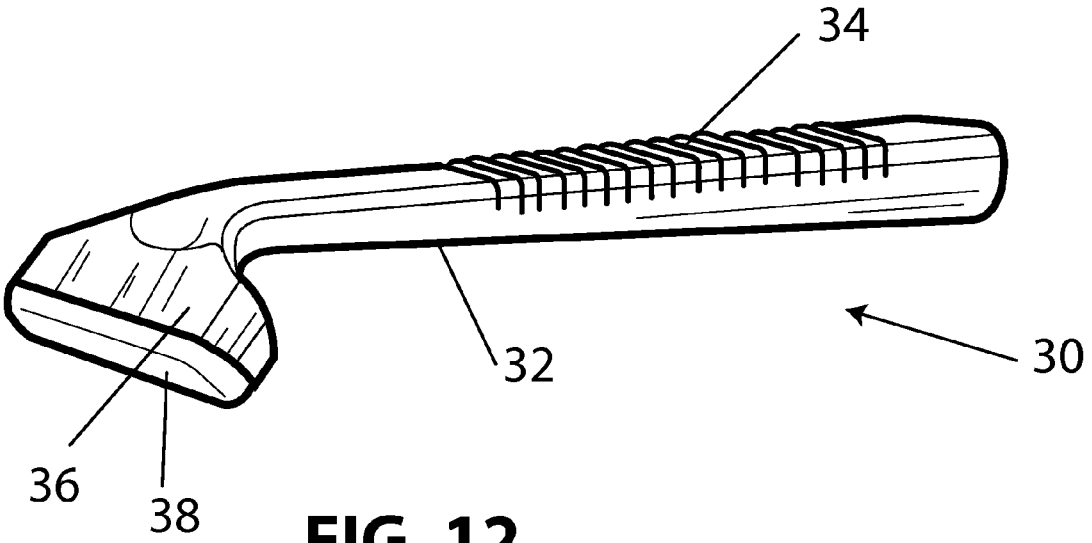
Figure 13:
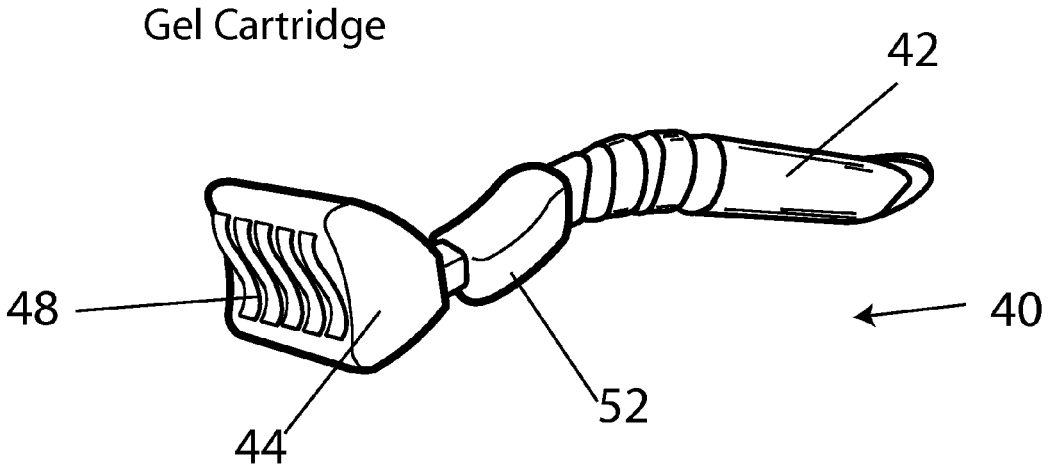
Figure 14:
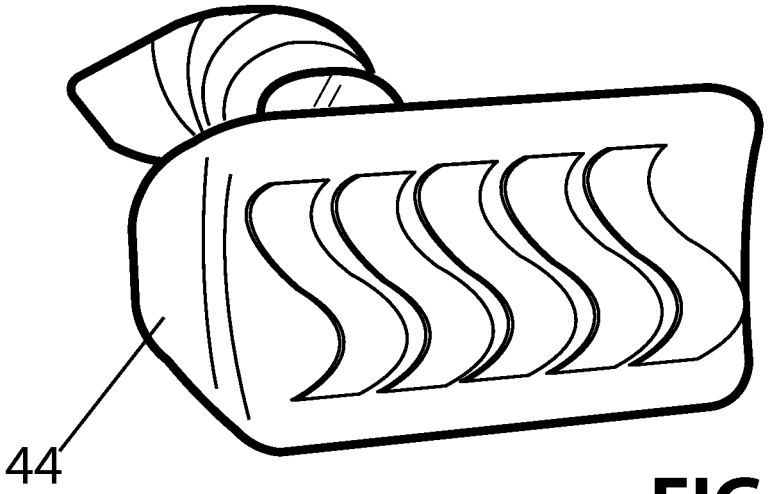
Figure 15:
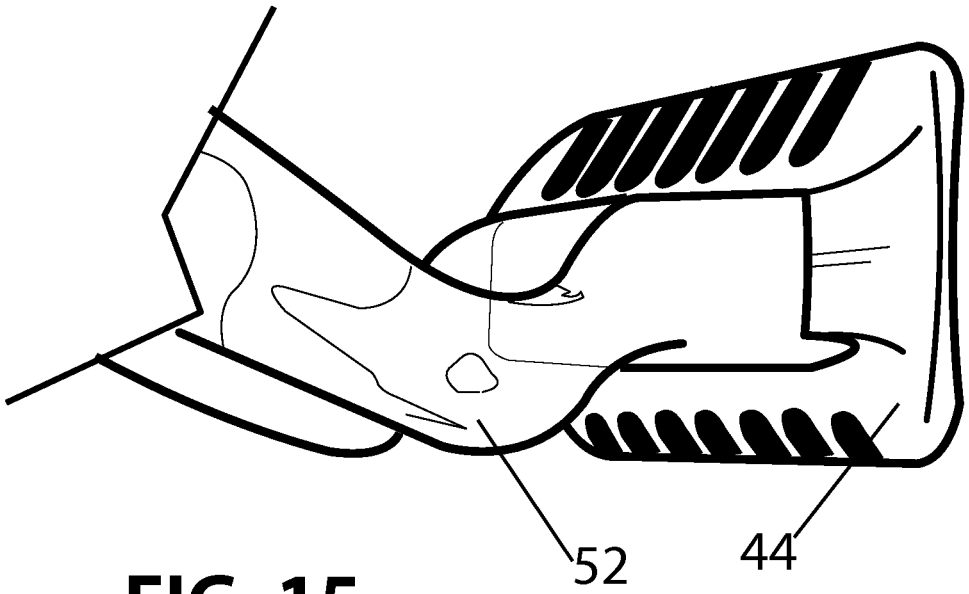

FIG. 11*d* shows the cross-sectional schematic illustration of the applicator of FIG. 11*c* with the sponge material removed;

FIG. 12 shows a schematic illustration of yet another exemplary embodiment of a skin care and shaving system including a handle, and an applicator member attached to an end of the handle;

FIG. 13 shows a schematic illustration of an exemplary embodiment of a skin care system including a handle, and a gel applicator member attached to an end of the handle;

FIG. 14 shows a schematic end view of the skin care system of FIG. 13; and FIG. 15 shows a schematic bottom view of the gel applicator member of FIG. 13.

Figure 16:
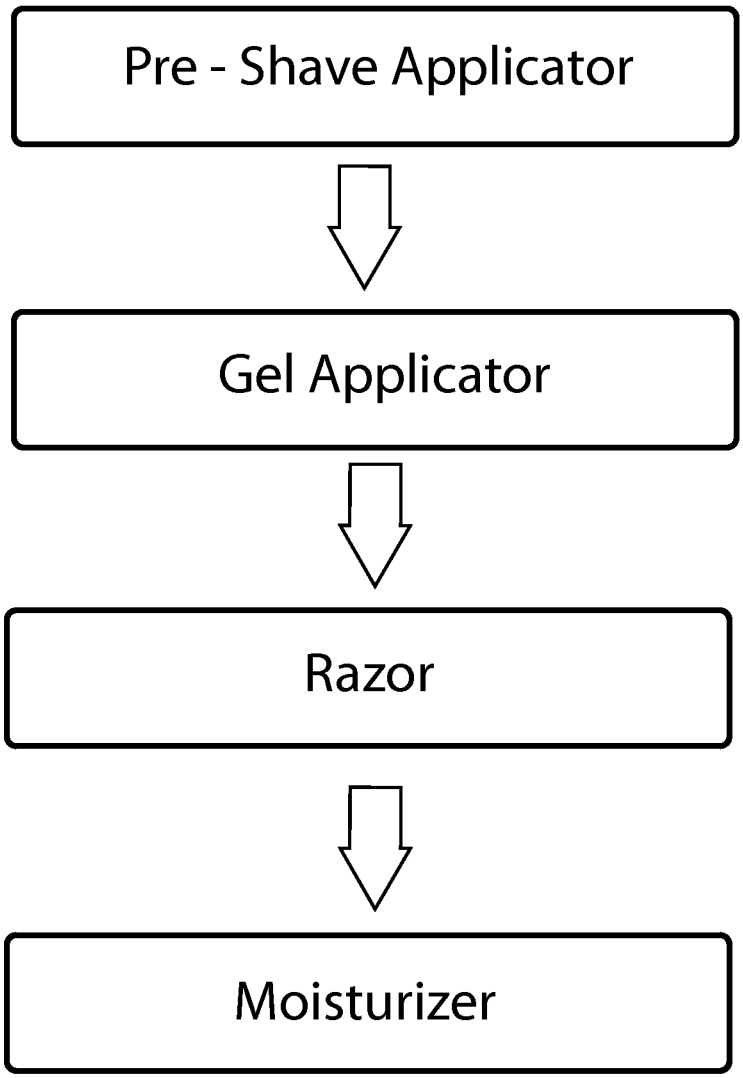

FIG. 16 shows a flow chart representation of usage of the skin engaging applicator of the present invention.

DETAILED DESCRIPTION OF INVENTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
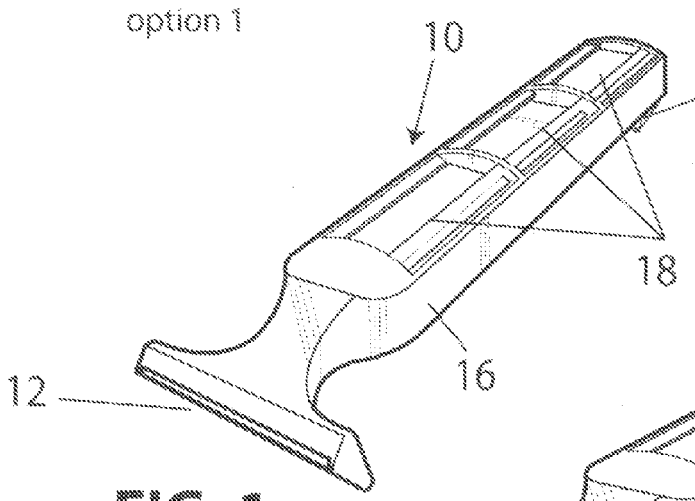
Figure 1A:
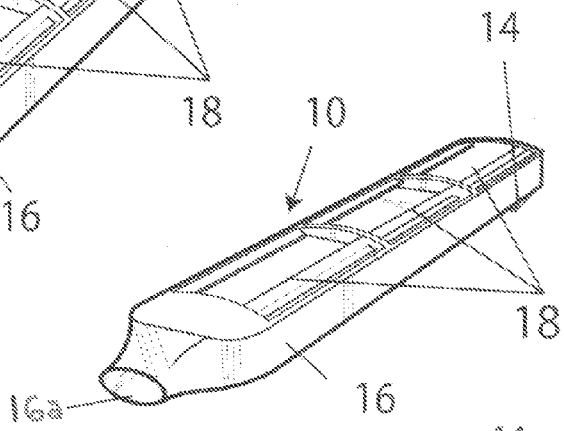
Figure 1B:
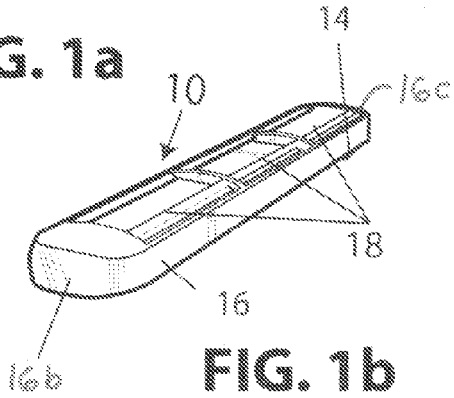

The invention is applicable to skin enhancer cartridges in general that are used in a wet shaving system. Referring to the drawings, FIGS. 1-7 show the design and method of an exemplary embodiment of using a wet shaving system, in accordance with an aspect of the present invention. Specifically, FIG. 1 shows a skin enhancer shaving system 10, comprising a razor cartridge 12 disposed at one end of a handle 16. The razor cartridge 12 contains one or more shaving blades suitable for hair shaving. The razor cartridge 12 may be (i) disposable, (ii) detachably connected to the handle 16 through a grip arrangement method, or (iii) can be designed as a disposable unitary system. Alternatively, the razor cartridge 12 may be connected to the handle 16 through a linker that provides flexible movement of the razor blades while shaving. As shown, the handle 16 comprises two or more disposable skin engaging applicators 18 detachably fixed to the housing 20 (as clearly shown in FIG. 2) of the handle 16. As shown in FIG. 1*a* according to one embodiment, handle 16 is designed in a manner such that a tip 16*a* of the handle 16 can be detachably attached to existing razor blades and used during pre shave and post shave purpose. Preferably, the tip 16*a* of the handle 16 with applicator member 18 fixes to the razor blades by grip arrangement method or screw method or even by plugging method whichever is suitable for easy usage. Alternatively, as shown in FIG. 1*b*, the applicator member 18 is fixed onto a base holder 14 of a rectangular flat shape comprising blunt shapes 16*b* and 16*c* on both sides. Such type of arrangement can be used as a unitary object while using electric shaver wherein the applicator member 18 with sponge can be used for applying pre-shave and after-shave lotions, cream, gel, moisturizer etc. as required and shaving can be done using electric shavers or also normal razor cartridges. Further, a small portion of the handle or the whole outer surface is designed to have a rough surface or rubber coating which enables firm holding of the handle while in use and prevents the object from slipping. Alternatively, as shown in FIG. 1*b*, the applicator member is fixed onto a base holder 16 of a rectangular flat shape comprising blunt shapes 16*b* and 16*c* on both sides. Such type of arrangement can be used as a unitary object while using electric shaver wherein the applicator member with sponge can be used for applying pre-shave and after-shave lotions, cream, gel, moisturizer etc. as required and shaving can be done using electric shavers or also normal razor cartridges. Further, a small portion of the handle or the whole outer surface 14 is designed to have a rough surface or rubber coating which enables firm holding of the handle while in use and prevents the object form slipping Preferably, the skin-engaging applicator 18 comprises a sponge material, for example, a hydrophilic foam pad and/or latex-free sponge, or the like, which helps in application of one or more of a shaving lotion, a shaving cream, a shaving gel, a shaving foam cream, a skin conditioning foam, and a skin moisturizer during pre and post shave. The sponge material used in the skin enhancer shaving system 10 may include small and/or large pores, depending on the shaving application. For example, for pre-shave, a sponge with small pores may be preferred, while for shaving gel, a sponge with larger pores is preferable. Similarly, for skin cream application, latex-free sponge materials or the like is preferable.

Figure 2:
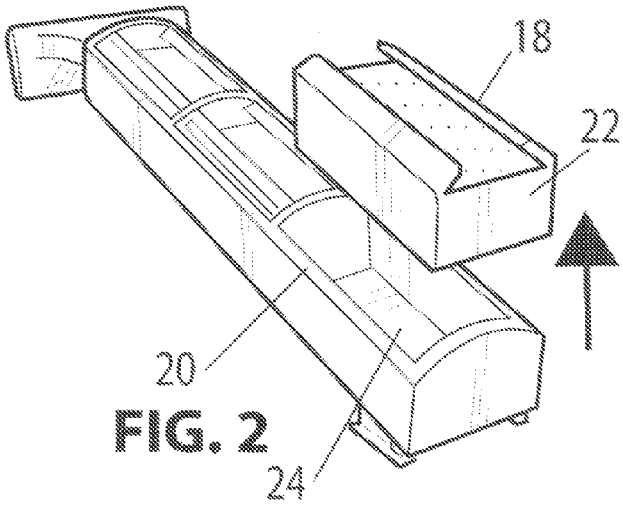
FIG. 2 shows a schematic illustration of the skin care and shaving system of FIG. 1, with the applicator member removed from the upper side of the handle.

As best seen in FIG. 2, each skin engaging applicator 18 is embedded in an applicator base 22, where the applicator base 22 is detachably fixed along the housing 20 of the handle 16. The width of the applicator base 22 is smaller than the width of the handle 16 such that skin engaging applicator 18 can be retained in the housing 20 of the handle 16. While not in use in the shaving process, the skin engaging applicator 18 is secured within the handle 16 with the sponge material facing into the handle 16 and the applicator base 22 facing outward, as shown in FIG. 1.

Figure 3:
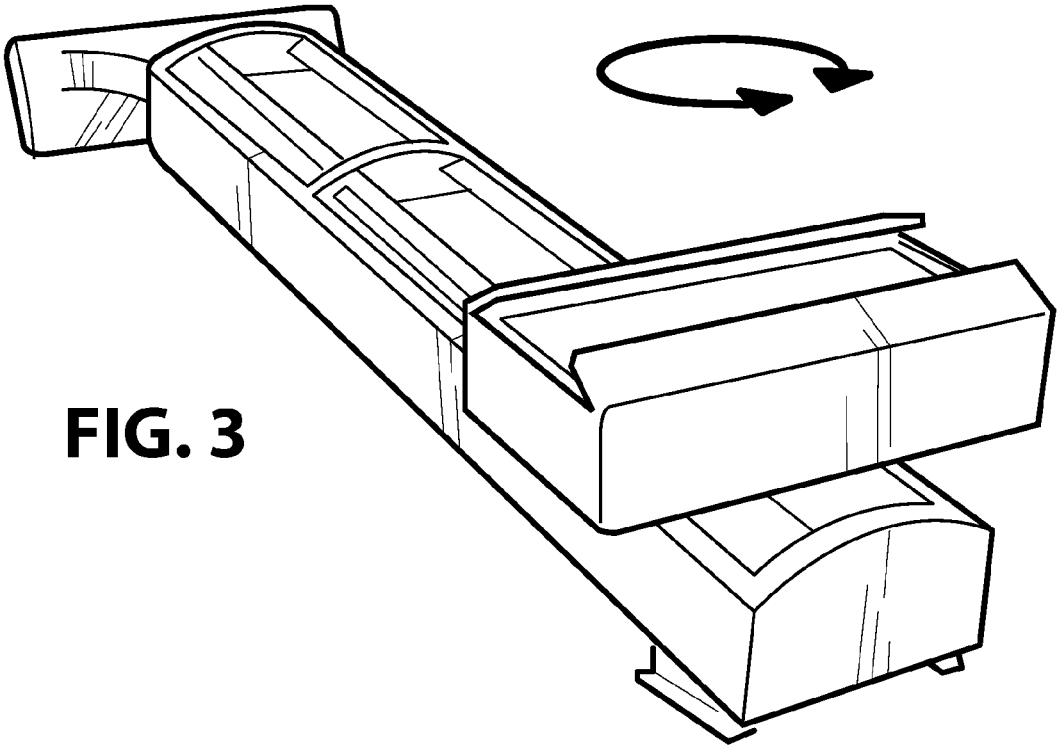
FIG. 3 shows a schematic illustration of the skin care and shaving system of FIG. 2, with the applicator member rotated relative to the handle.
Figure 4:
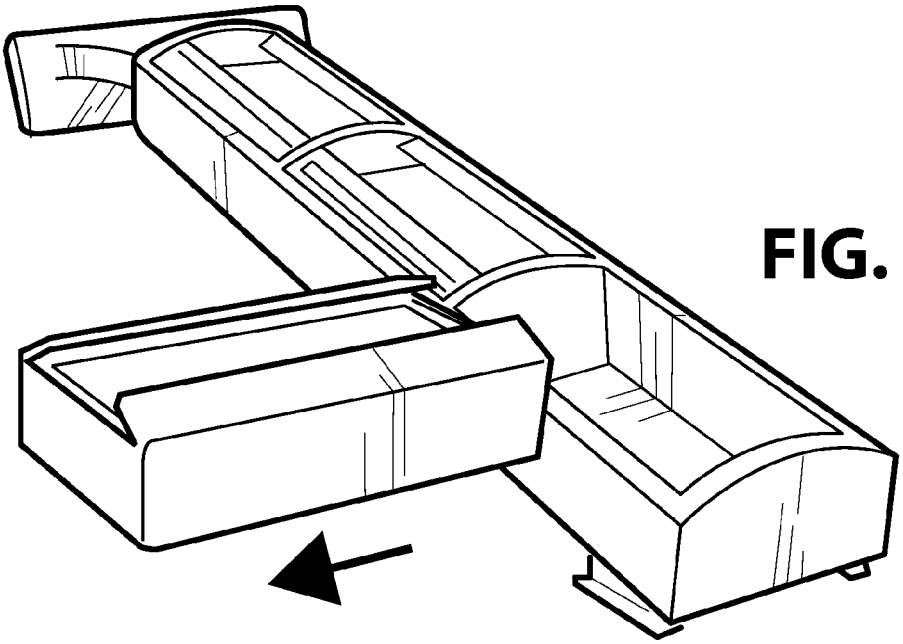
FIG. 4 shows a schematic illustration of the skin care and shaving system of FIG. 3, with the applicator member translated relative to the handle.
Figure 5:
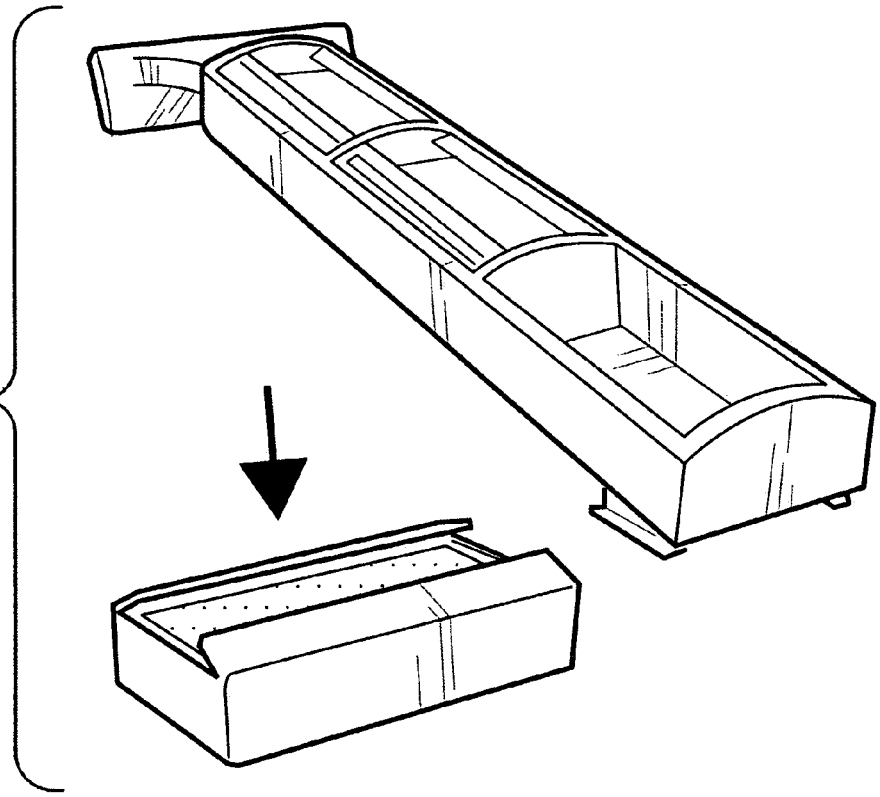
FIG. 5 shows a schematic illustration of the skin care and shaving system of FIG. 4, with the applicator member positioned relative to the underside of the handle.
Figure 6:
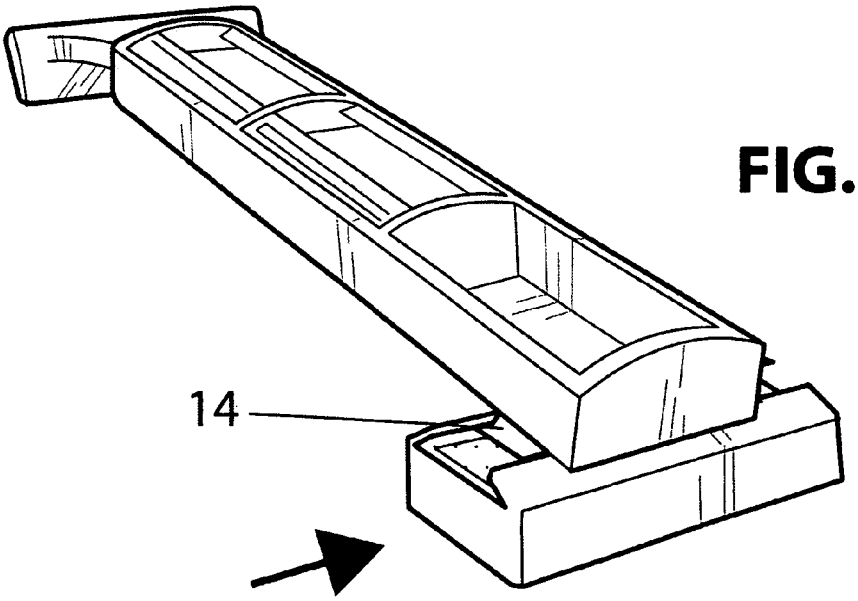
FIG. 6 shows a schematic illustration of the skin care and shaving system of FIG. 5, with the applicator member is fixed into the underside of the handle.
Figure 7:
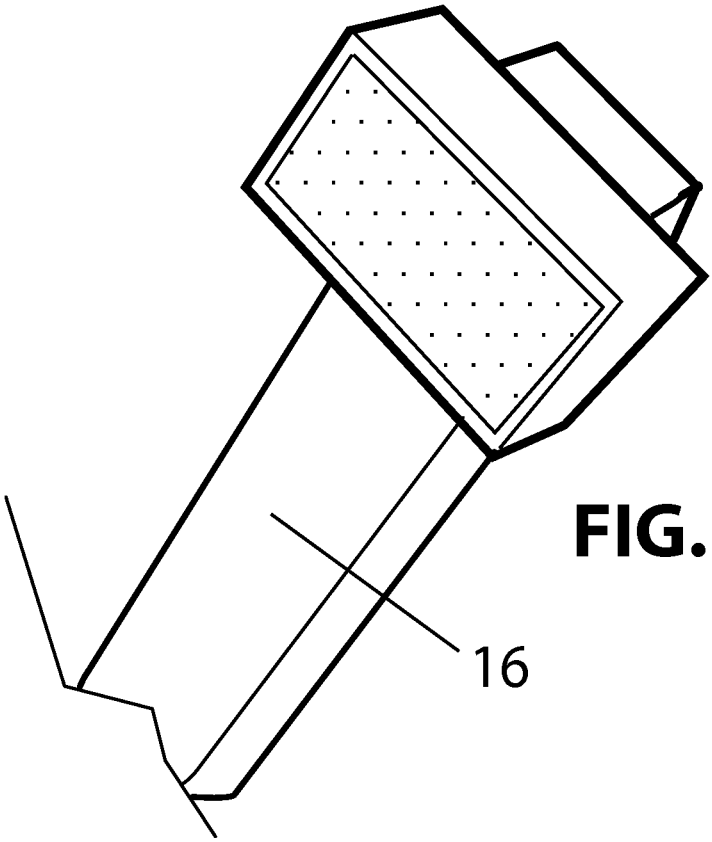
FIG. 7 shows an isometric schematic illustration of the skin care and shaving system of FIG. 5.

In the process of shaving, in accordance with an aspect of the present invention, one of the skin engaging applicators 18 may be removed upward from a respective cavity 24 in the handle 16, as shown in FIG. 2. The handle 16 may be formed from a pliable plastic material. The selected skin engaging applicator 18 may be turned horizontally, as shown in FIG. 3, aligning perpendicularly to the handle 16, and may be moved to the opposite side of the handle 16, as shown in FIG. 5, and fixed to the distal end of the handle 16 with the sponge material facing outward, as shown in FIGS. 6 and 7.

Hence, during pre and post shave, the skin engaging applicator 18 can be used in the aforesaid manner for application of various skin enhancers, such as cream, shaving lotions, gel, foam etc. The skin engaging applicator 18 can then be disposed after use. During pre-shave activity, the skin engaging applicator 18 may be used first, and then disposed following shaving with the disposable razor cartridge 12. Similarly, for post-shave activity, the disposable razor cartridge 12 can be used for shaving hair, and then the skin engaging applicator 18 can be used for applying skin moisturizer, cream or the like.

Figure 8:
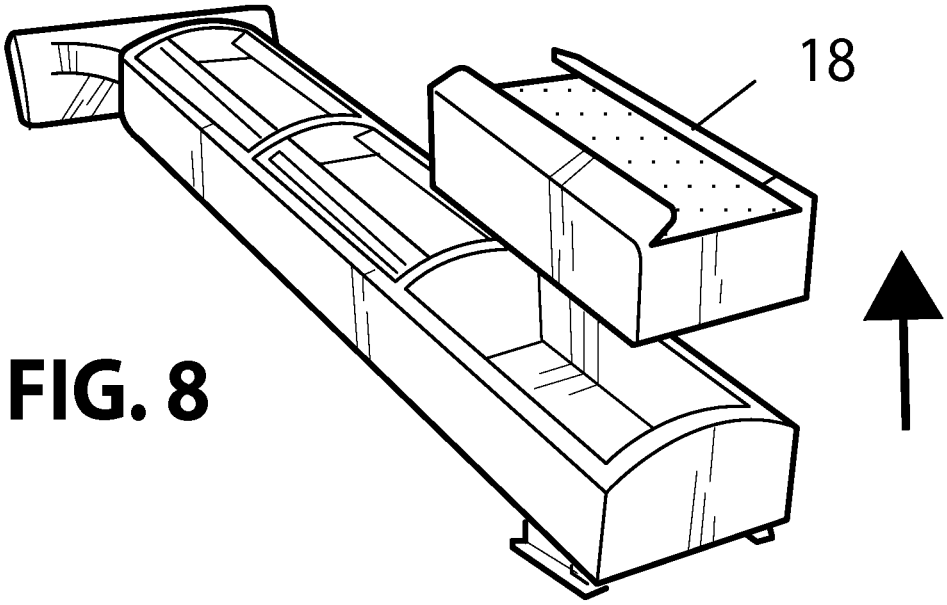
FIG. 8 shows a schematic illustration of another exemplary embodiment of a skin care and shaving system including a handle, a razor cartridge, and an applicator member being removed from the handle, in accordance with the present invention.
Figure 9:
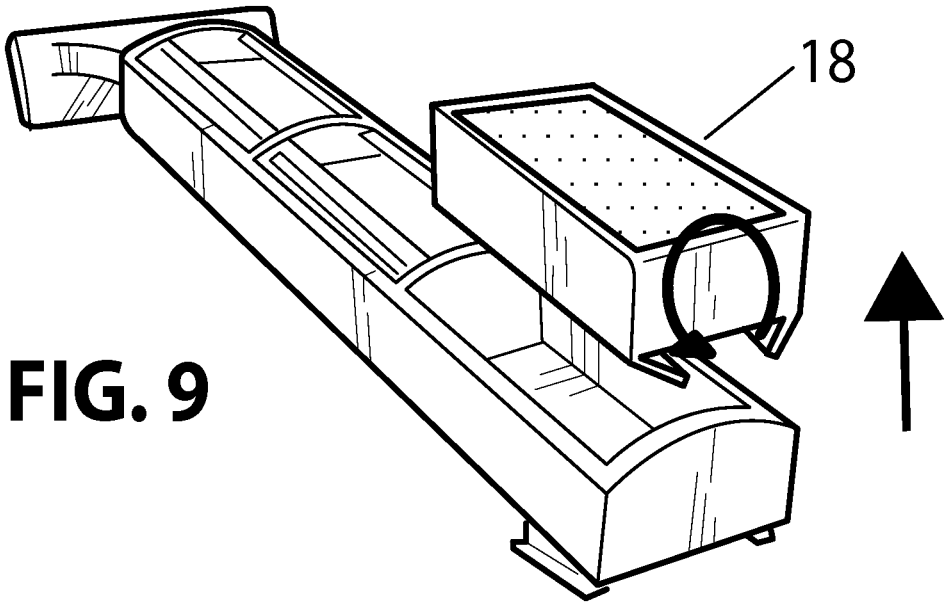
FIG. 9 shows a schematic illustration of the skin care and shaving system of FIG. 8 with the applicator member rotated along a longitudinal axis of the handle.
Figure 10:
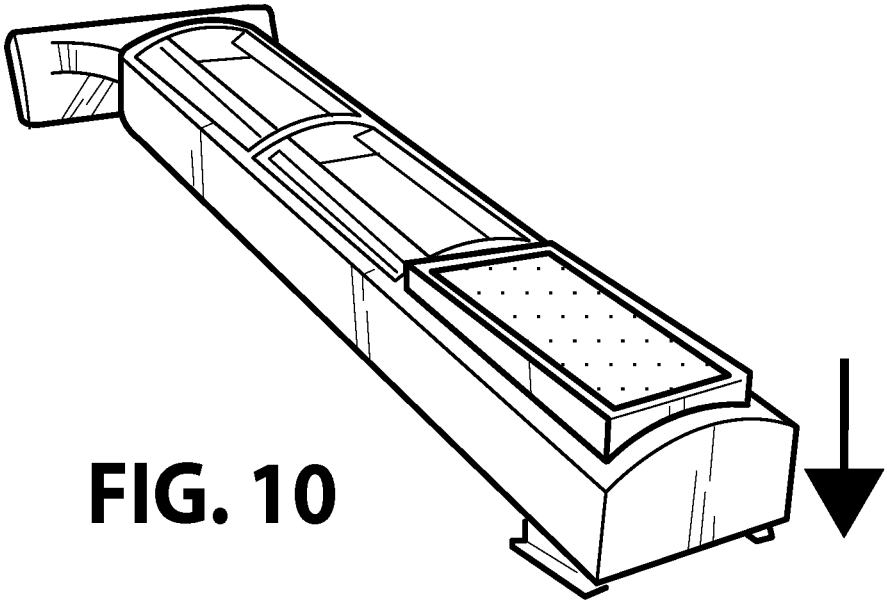
FIG. 10 shows a schematic illustration of the skin care and shaving system of FIG. 9 with the rotated applicator repositioned in the handle.

In an alternate embodiment, as shown in FIGS. 8-10, the skin engaging applicator 18 is similarly removed from the cavity 24 in the housing 20 of the handle 16, as shown in FIG. 8, turned upside down exposing the sponge material upwards, as shown in FIG. 9, and then fixed in the cavity 24 on the handle, as shown in FIG. 10.

FIG. 11 *a-d* illustrates an exemplary embodiment of skin engaging applicator of the present invention. The applicator 18 shows a base 22 that holds the sponge material 26 as shown in the figure. In an embodiment the sponge material or a hydrophilic foam or the like is fixed and glued into the applicator base 22 by water proof adhesives such that the sponge remains firm while wet shaving process without detaching from the base. Further, in another embodiment the sponge material is positioned into the base in a manner such that level of the sponge slightly extends or protrudes above the plane of the base holding it. Hence, while applying lotion, cream, gel etc. on the skin, the sponge material on the applicator is softly pressed against the skin and application is carried out with ease without the hard plastic base being touched to the skin causing discomfort.

FIG. 12 illustrates a skin enhancer and moisturizer cartridge 30 in accordance with another embodiment of the present invention. The skin enhancer and moisturizer cartridge 30 may be used for pre and post shave purposes for applying shaving lotion, cream, and moisturizer therein, and can also be used by women for applying skin cream as a part of make-up kit. As shown in FIG. 12, the skin enhancer and moisturizer cartridge 30 is fixed to a handle 32, where the surface 34 of the handle 32 may have a non-smooth surface for firm holding. One end of the handle 32 forms the head 36 comprising the skin engaging applicator member 38 of the skin enhancer and moisturizer cartridge 30 for applying skin enhancers.

In the embodiment shown in FIG. 12, the width of the head of the skin enhancer and moisturizer cartridge 30 ranges from about 20 to about 40 mm, and the length of the handle 32 can range from about 90 to about 100 mm. Preferably, the skin enhancer and moisturizer cartridge 30 may comprise pliable plastic, rubber or a similar material. The skin enhancer and moisturizer cartridge 30 may comprise a whole disposable unitary device or, in another embodiment, the head 36 of the disposable skin enhancer and moisturizer cartridge 30 can be detachably connected to one end of the handle 32, such that the handle 32 can be reused.

Usually, according to the present invention, the skin enhancer and moisturizer cartridge 30 may comprise a sponge material, such as a hydrophilic foam pad and/or latex free sponge or the like, which helps in application of shaving lotion, shaving cream, shaving gel, shaving foam cream, skin conditioning foam, skin moisturizer during pre and post shave. The sponge used in this type of shaving system may include small and/or large pores depending on its use. For example, for pre-shave, a sponge with small pores is preferred, while for shaving gel, a sponge with larger pores may be used. Similarly, for skin cream application, latex-free sponge materials or the like can be used.

Further, in FIG. 13 is shown a gel cartridge 40 of the present invention. The gel cartridge 40 is a disposable component attached to a flexi rubber handle 42. The gel cartridge 40 may comprise a skin engaging applicator member 44 made up of absorbent sponge or foam material 46, interspersed with hard foam or rubber material 48, as shown in FIG. 13. The handle 42 and the skin engaging applicator member 44 are connected through a linker 52 made up of plastic comprising grip arrangement method to hold the head of the skin engaging applicator member 44 and corresponding hole or housing for attachment of one end of the flexi rubber handle 42, as shown in FIG. 14. The linker 52 and the design of the flexi rubber handle 42 provides a flexi-movement of the skin engaging applicator member 44 while applying gel cream or shaving gel on the skin as shown in FIG. 15. As shown in FIG. 13, the flexi rubber handle 42 comprises rough surface or groove structure in order to enable firm holding during usage. In an embodiment, the flexi rubber handle 42 can be fabricated from plastic material or the like. The rubber or hard foam 48 enables uniform application of shaving gel in the target area.

As shown in FIG. 1, there are razor blades present in the disposable razor cartridge 12 and hence shaving is carried out in normal available razor cartridges. The products of the present invention uses all types of skin enhancer for pre and post shave and also various other cream and moisturizer that are already present in the market. The present invention provides an easy and simple way of application of shaving and skin enhancers thereby improving shaving experience.

FIG. 16 illustrates a flow chart explaining the method of usage of the skin care and shaving system for both men and women according to an embodiment of the present invention. A pre-shave applicator is used to apply pre-shave moisturizer, lotion, cream etc before shaving through skin engaging absorbent material, following applying gel, shaving cream, lotion using gel cartridge system of the present invention. Shaving procedure is carried out by aforementioned razors of general state of art. Post shaving procedure, a moisturizer cartridge is used to apply skin moisturizer or creams for reducing razor bumps, razor irritation and helps to retain a smooth and soothing skin thereof.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

What is claimed is:

1. A skin care and shaving system comprising:

a handle having at least one cavity in a housing of said handle and a base holder disposed on a surface of said housing, said handle further including a handle tip for detachable connection to a razor cartridge; and;

a disposable skin engaging applicator with an applicator base retained in a first cavity of said at least one cavity, said skin-engaging applicator detachable from said first cavity and attachable to said base holder for dispensing a skin enhancer.

2. The skin care and shaving system of claim 1, wherein said handle tip detachably connects to the razor cartridge through one of a linker or a grip arrangement.

3. The skin care and shaving system of claim 1, wherein said disposable skin engaging applicator comprises one of: a sponge material, a hydrophilic foam pad, or a latex free sponge material.

4. The skin care and shaving system of claim 1, wherein said skin enhancer comprises at least one of a liquid, a pre-shave lotion, a gel, a moisturizer, a skin cream, and a paste.

5. The skin care and shaving system of claim 1, wherein said skin engaging applicator comprises a foam pad imbedded in said applicator base.

6. The skin care and shaving system of claim 5, wherein said handle comprises at least one of a pliable plastic or a rubber material.

7. A method of skin care and shaving, said method comprising the steps of:

providing a razor cartridge for attachment to a handle having at least one cavity and a handle tip;

removably attaching said razor cartridge to said handle tip;

removing a skin engaging applicator having a foam pad secured in an applicator base from said at least one cavity in said handle; and attaching said applicator base to a base holder disposed on a surface of said handle so as to expose said foam pad.

8. A applicator member suitable for use with a skin enhancer cartridge system, said applicator member comprising:

a skin engaging applicator, said skin engaging applicator including an applicator base and one of a sponge or a foam pad embedded in said applicator base;

a handle having a base holder configured for attachment to said applicator base, said handle further having at least two cavities extending into a surface of a housing of said handle, each said cavity configured so as to detachably retain said applicator base and allow removal of said skin engaging applicator by lifting said applicator base away from said surface;

wherein, said applicator member is used during pre and post shave by attaching to said base holder.

9. The applicator member of claim 8, wherein said handle comprises a pliable plastic, or rubber material.

10. The applicator member of claim 8, wherein said skin engaging applicator comprises at least one of a sponge material, hydrophilic foam pad or latex-free sponge material.

11. The applicator member of claim 10, wherein said at least one of a sponge material, hydrophilic foam pad or latex-free sponge material is fixed to said applicator base.

12. The applicator member of claim 10, wherein said at least one of a sponge material, hydrophilic foam pad or latex-free sponge material extends above said applicator base.

13. The applicator member of claim 10, wherein said skin engaging applicator comprises a sponge having at least one of small pores or larger pores.

14. The applicator member of claim 8, wherein said skin enhancers comprises a member of the group consisting of a liquid, a pre-shave lotion, a gel, a moisturizer, a skin cream, or a paste.

* * * * *